US008102318B2

(12) United States Patent
Chiang et al.

(10) Patent No.: US 8,102,318 B2
(45) Date of Patent: Jan. 24, 2012

(54) INVERTED-F ANTENNA WITH BANDWIDTH ENHANCEMENT FOR ELECTRONIC DEVICES

(75) Inventors: Bing Chiang, Cupertino, CA (US); Enrique Ayala Vazquez, Watsonville, CA (US)

(73) Assignee: Apple Inc., Cupertino, CA (US)

( * ) Notice: Subject to any disclaimer, the term of this patent is extended or adjusted under 35 U.S.C. 154(b) by 409 days.

(21) Appl. No.: 12/401,594

(22) Filed: Mar. 10, 2009

(65) Prior Publication Data

US 2010/0231460 A1 Sep. 16, 2010

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 6,127,987 | A | 10/2000 | Maruyama et al. | |
| 6,646,605 | B2 | 11/2003 | McKinzie et al. | |
| 6,831,607 | B2 | 12/2004 | Hebron et al. | |
| 6,836,249 | B2 * | 12/2004 | Kenoun et al. | 343/700 MS |
| 6,903,690 | B2 * | 6/2005 | Leclerc et al. | 343/700 MS |
| 7,126,553 | B1 | 10/2006 | Fink et al. | |
| 7,345,634 | B2 | 3/2008 | Ozkar et al. | |
| 2004/0075611 | A1 | 4/2004 | Kenoun et al. | |
| 2006/0256017 | A1 * | 11/2006 | Ishizaki | 343/700 MS |
| 2007/0069956 | A1 * | 3/2007 | Ozkar | 343/700 MS |
| 2007/0120740 | A1 | 5/2007 | Iellici et al. | |
| 2007/0216594 | A1 | 9/2007 | Uno et al. | |
| 2009/0079654 | A1 * | 3/2009 | Higaki et al. | 343/795 |
| 2010/0188298 | A1 * | 7/2010 | Suzuki et al. | 343/702 |

* cited by examiner

*Primary Examiner* — Hoanganh Le
(74) *Attorney, Agent, or Firm* — Treyz Law Group; G. Victor Treyz; David C. Kellogg

(57) ABSTRACT

An inverted-F antenna is provided that has a resonating element arm and a ground element. A shorting branch of the resonating element arm shorts the resonating element arm to the ground element. An antenna feed that receives a transmission line is coupled to the resonating element arm and the ground element. One or more impedance discontinuity structures are formed along the resonating element arm at locations that are between the shorting branch and the antenna feed. The impedance discontinuity structures may include shorting structures and capacitance discontinuity structures. The impedance discontinuity structures may be formed by off-axis vertical conductors such as vias that pass through a dielectric layer separating the antenna resonating element arm from the ground element. Capacitance discontinuity structures may be formed from hollowed portions of the dielectric or other dielectric portions with a dielectric constant that differs from that of the dielectric layer.

22 Claims, 10 Drawing Sheets

INVERTED-F ANTENNA WITH BANDWIDTH ENHANCEMENT FOR ELECTRONIC DEVICES

BACKGROUND

This invention relates to electronic devices and, more particularly, to antennas for electronic devices.

Portable computers and other electronic devices often use wireless communications circuitry. For example, wireless communications circuitry may be used to communicate with local area networks and remote base stations.

Wireless computer communications systems use antennas. It can be difficult to design antennas that perform satisfactorily in electronic devices. For example, it can be difficult to produce an antenna that is suitable for volume manufacturing and that performs efficiently over communications frequencies of interest.

It would therefore be desirable to be able to provide improved antenna arrangements for electronic devices such as portable computers.

SUMMARY

An antenna for an electronic device is provided. The antenna may have an inverted-F configuration based on an antenna ground element and a resonating element arm. A shorting branch of the resonating element arm may short the resonating element arm to the ground element. At another location along the longitudinal axis of the resonating element arm, an antenna feed may be provided that is coupled to a transmission line.

Antenna bandwidth may be enhanced by including one or more impedance discontinuity structures in the antenna at locations along the resonating element arm between the shorting branch and the antenna feed. The impedance discontinuity structures may be implemented using shorting structures and capacitance discontinuity structures.

The resonating element arm may be formed from traces on a printed circuit board dielectric layer. The ground element may be formed using a ground plane layer on the dielectric. The shorting structures may be formed by creating off-axis vias through the dielectric to connect the resonating element arm to the ground element. The capacitance discontinuity structures may be formed from regions in the dielectric layer under the antenna resonating element arm. The regions may have an increased or decreased dielectric constant relative to the dielectric constant of the dielectric layer. A capacitance discontinuity structure may, for example, be formed from a hollow portion of the dielectric under the resonating element arm.

Further features of the invention, its nature and various advantages will be more apparent from the accompanying drawings and the following detailed description of the preferred embodiments.

DETAILED DESCRIPTION

The present invention relates to antenna structures for electronic devices. Antennas may be used to convey wireless signals for suitable communications links. For example, an electronic device antenna may be used to handle communications for a short-range link such as an IEEE 802.11 link (sometimes referred to as WiFi®) or a Bluetooth® link. An electronic device antenna may also handle communications for long-range links such as cellular telephone voice and data links.

Antennas such as these may be used in various electronic devices. For example, an antenna may be used in an electronic device such as a handheld computer, a miniature or wearable device, a portable computer, a desktop computer, a router, an access point, a backup storage device with wireless communications capabilities, a mobile telephone, a music player, a remote control, a global positioning system device, devices that combine the functions of one or more of these devices and other suitable devices, or any other electronic device.

Figure 1:
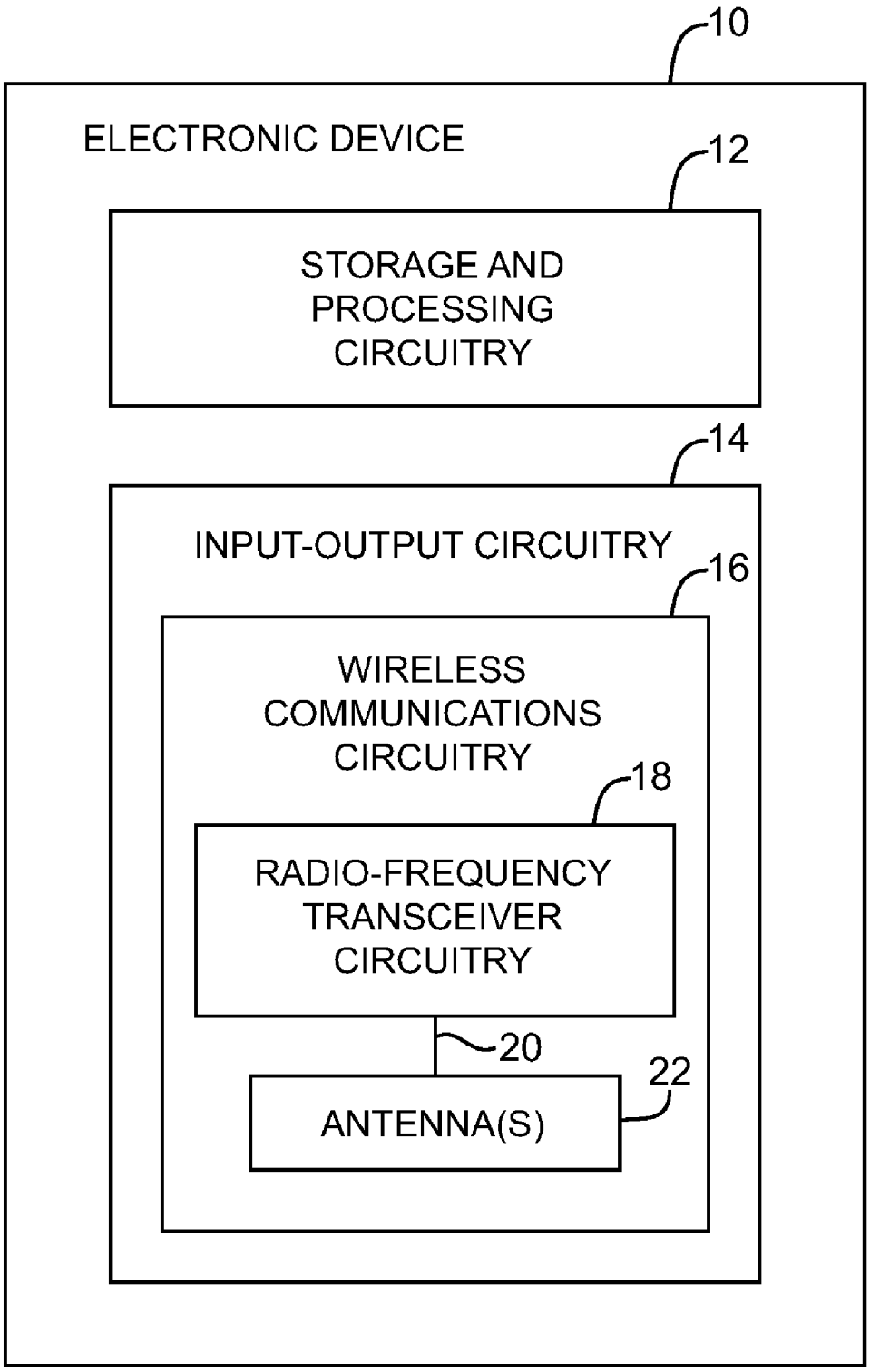
FIG. 1 is a schematic diagram of an illustrative electronic device in which an antenna may be implemented in accordance with an embodiment of the present invention.

A schematic circuit diagram of an illustrative electronic device 10 that may include one or more antennas is shown in FIG. 1. As shown in FIG. 1, device 10 may include storage and processing circuitry 12 and input-output circuitry 14. Storage and processing circuitry 12 may include hard disk drives, solid state drives, optical drives, random-access memory, nonvolatile memory and other suitable storage. Storage may be implemented using separate integrated circuits and/or using memory blocks that are provided as part of processors or other integrated circuits.

Storage and processing circuitry 12 may include processing circuitry that is used to control the operation of device 10. The processing circuitry may be based on one or more circuits such as a microprocessor, a microcontroller, a digital signal processor, an application-specific integrated circuit, and other suitable integrated circuits. Storage and processing circuitry 12 may be used to run software on device 10 such as operating system software, code for applications, or other suitable software. To support wireless operations, storage and processing circuitry 12 may include software for implementing wireless communications protocols such as wireless local area network protocols (e.g., IEEE 802.11 protocols—sometimes referred to as Wi-Fi®), protocols for other short-range wireless communications links such as the Bluetooth® protocol, protocols for handling 3G communications services (e.g., using wide band code division multiple access techniques), 2G cellular telephone communications protocols, WiMAX® communications protocols, communications protocols for other bands, etc.

Input-output devices 14 may be used to allow data to be supplied to device 10 and to allow data to be provided from device 10 to external devices. Input-output devices 14 may include user input-output devices such as buttons, display screens, touch screens, joysticks, click wheels, scrolling wheels, touch pads, key pads, keyboards, microphones, speakers, cameras, etc. A user can control the operation of device 10 by supplying commands through the user input devices. This may allow the user to adjust device settings, etc. Input-output devices 14 may also include data ports, circuitry for interfacing with audio and video signal connectors, and other input-output circuitry.

As shown in FIG. 1, input-output devices 14 may include wireless communications circuitry 16. Wireless communications circuitry 16 may include communications circuitry such as radio-frequency (RF) transceiver circuitry 18 formed from one or more integrated circuits such as a baseband processor integrated circuit and other radio-frequency transmitter and receiver circuits. Circuitry 18 may include power amplifier circuitry, transmission lines such as transmission line(s) 20, passive RF components, antennas 22, and other circuitry for handling RF wireless signals.

Electronic device 10 may include one or more antennas such as antenna 22. The antenna structures in device 10 may be used to handle any suitable communications bands of interest. For example, antennas and wireless communications circuitry in device 10 may be used to handle cellular telephone communications in one or more frequency bands and data communications in one or more communications bands. Typical data communications bands that may be handled by wireless communications circuitry 16 include the 2.4 GHz band that is sometimes used for Wi-Fi® (IEEE 802.11) and Bluetooth® communications, the 5 GHz band that is sometimes used for Wi-Fi® communications, the 1575 MHz Global Positioning System band, and 2G and 3G cellular telephone bands. These bands may be covered using single-band and multiband antennas. For example, cellular telephone communications can be handled using a multiband cellular telephone antenna. A single band antenna may be provided to handle Bluetooth® communications. Device 10 may, as an example, include a multiband antenna that handles local area network data communications at 2.4 GHz and 5 GHz (e.g., for IEEE 802.11 communications), a single band antenna that handles 2.4 GHz IEEE 802.11 communications and/or 2.4 GHz Bluetooth® communications, or a single band or multiband antenna that handles other communications frequencies of interest. These are merely examples. Any suitable antenna structures may be used by device 10 to cover communications bands of interest.

With one suitable arrangement, which is sometimes described herein as an example, antennas such as antenna 22 are formed using an inverted-F antenna design. If desired, this type of configuration may be implemented using planar structures to form a planar inverted-F antenna (PIFA). An inverted-F antenna arrangement may be used to cover one or more communications bands of interest. Bandwidth can be enhanced by including perturbing structures such as short circuit structures and capacitance discontinuity structures in the inverted-F structure.

Figure 2A:
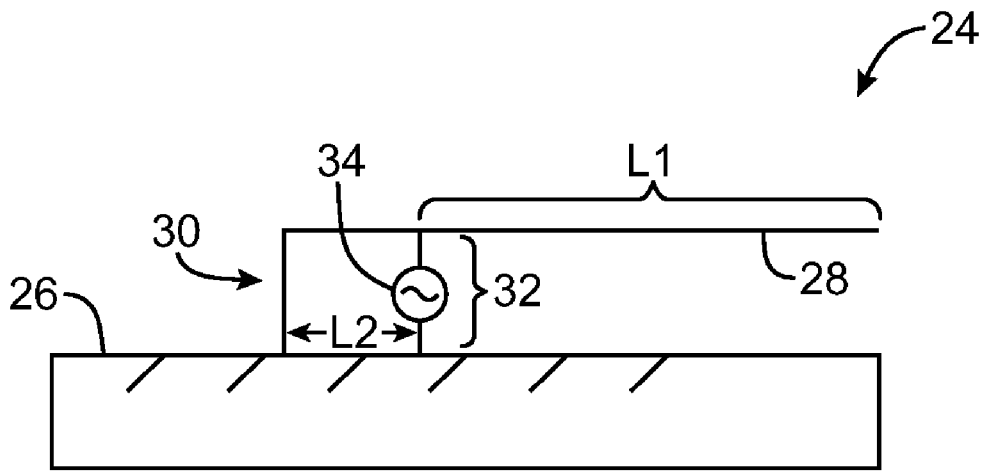
(PRIOR ART) FIG. 2A
FIG. 2A is a diagram of a conventional inverted-F antenna.

A schematic diagram of a conventional inverted-F antenna is shown in FIG. 2A. As shown in FIG. 2A, antenna 24 has a ground 26 and a main resonating element 28. Arm 28 has branches 30 and 32. Branch 30 connects resonating element arm 28 to ground 26 and thereby forms a short circuit. Radio-frequency circuit 34 is associated with branch 32 and feeds antenna 24. The separation L2 between arm 32 and arm 30 influences the impedance of antenna 24. If the size of L2 is reduced, feed 34 is moved closer to short circuit branch 30, so the input impedance tends to decrease.

The frequency response of antenna 24 is influenced by the length L1 of arm 28. Maximum antenna performance is generally obtained at radio-frequency signal frequencies at which L1 is equal to about a quarter of a wavelength.

Figure 2B:
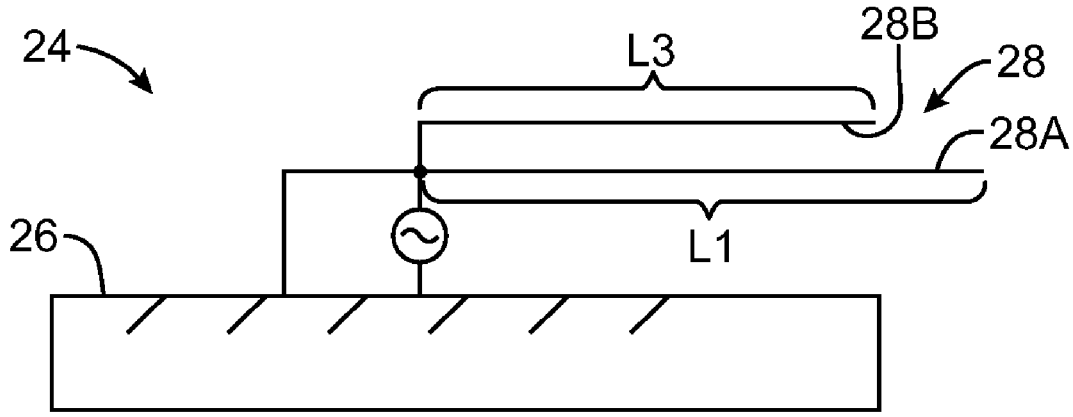
(PRIOR ART) FIG. 2B
FIG. 2B is a diagram of a conventional inverted-F antenna such as the antenna of FIG. 2A that has been modified with an additional resonating element arm to enhance antenna bandwidth.

Conventional inverted-F antennas of the type shown in FIG. 2A often have insufficient bandwidth to cover a communications band of interest. To address this issue, the resonating element arm 28 may be provided with two portions each having a different associated arm length. This type of conventional inverted-F antenna is shown in FIG. 2B. In the arrangement of FIG. 2B, antenna resonating element arm 28 has a first arm portion 28A with a length of L1 and a second arm portion 28B with a length of L3. Because lengths L1 and L3 are different, each arm portion will contribute a different resonance peak to the frequency response of antenna 24, thereby broadening its radio-frequency performance. However, it is not always desirable to broaden an antenna's bandwidth by adding additional segments to the resonating element arm, as this may not be permitted due to layout constraints and may involve rerouting the antenna layout.

Figure 3:
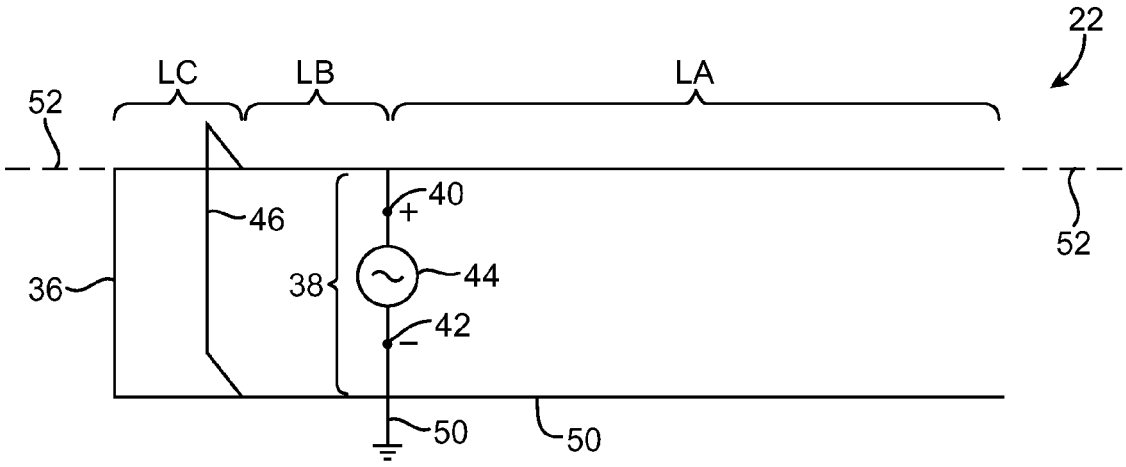
FIG. 3 is a diagram of an illustrative inverted-F antenna that has a short circuit structure that enhances antenna bandwidth in accordance with an embodiment of the present invention.

An arrangement for providing enhanced antenna bandwidth in accordance with an embodiment of the present invention is shown in FIG. 3. As shown in FIG. 3, antenna 22 may have a ground 50 and a main resonating element arm 34. Arm 34 has branches 36 and 38. Branch 36 connects arm 34 to ground 50 and forms a short circuit. Radio-frequency circuit 44 and associated antenna feed terminals 40 and 42 schematically represent a location at which transmission line 20 (FIG. 1) may be coupled to antenna 22 for feeding antenna 22. Terminal 40 may be a positive antenna feed terminal and terminal 42 may be a ground antenna feed terminal. Positive antenna feed terminal 40 may be electrically connected to resonating element arm 34, whereas ground antenna feed terminal 42 may be grounded to ground 50. Branch 38 and its associated antenna terminals may therefore serve as an antenna feed for antenna 22.

In addition to shorting branch 36, antenna 22 may be provided with one or more additional shorting structures. These structures are illustrated schematically by line 46 in FIG. 3. As shown in FIG. 3, shorting structures 46 provide a shorting path between resonating element arm 34 and ground 50 that is parallel to shorting path 36.

Shorting structures 46 are located at a different longitudinal location along resonating element longitudinal axis 52 than shorting path 36. For example, shorting structures 46 may be located a longitudinal distance LB from feed path 38, whereas shorting branch path 36 is located further along arm 34 at a distance LC from shorting structures 46. To ensure that shorting structures 46 do not overwhelm shorting path 36, shorting structures 46 may also be laterally offset from main resonating element longitudinal axis 52, as shown schematically in the diagram of FIG. 3.

With the arrangement of FIG. 3, length LA of resonating element arm 34 may be configured to be about a quarter of a wavelength at the antenna operating frequency of interest. When length LA is selected in this way, antenna 22 will cover this desired operating frequency. Bandwidth broadening may be provided by the impedance perturbations introduced by the impedance discontinuity associated with shorting structure 46. In the absence of shorting structures 46, antenna 22 would exhibit a gain peak at a given frequency. In the presence of shorting structures 46, the radio-frequency properties of antenna 22 are perturbed and a second, shifted gain peak may arise due to the presence of structures 46. When the contributions of the unperturbed and perturbed gain peaks are combined, the resulting overall bandwidth performance of antenna 22 tends to increase. The perturbation arises because in the presence of shorting structure 46 there are two possible contributors to signal reflections at the short circuit end of resonating element 34—the first being associated with short circuit branch 36 at a distance of LB+LC from feed branch 38 and the second being associated with short circuit structure 46 at a distance of LB from feed branch 38.

Antennas such as antenna 22 of FIG. 3 may be implemented as planar inverted-F structures or other suitable inverted-F structures using conductive components such as wires, conductive circuit board traces and vias, stamped metal foil, portions of a conductive housing or support for electronic device 10, etc.

With one suitable arrangement, antenna 22 may be implemented using a printed circuit board structure. In this type of configuration, resonating element arm 34 may be formed from circuit board trace and ground 50 may be formed from a planar ground plane structure on the circuit board (e.g., a backside conductive layer). Conductive materials in this type of antenna 22 may include copper, gold, tungsten, aluminum, etc. Branch conductors for forming shorting path 36, shorting structures 46, and conductive paths in branch 38 may be implemented using conductive vias. Vias may be formed, for example, by plating copper or otherwise forming suitable conductive materials within one or more openings in a printed circuit board substrate. The openings may be, for example, cylindrical holes that run vertically so that their longitudinal axes are perpendicular to longitudinal axis 52 of resonating element arm 34 and perpendicular to ground plane 50.

Figure 4:
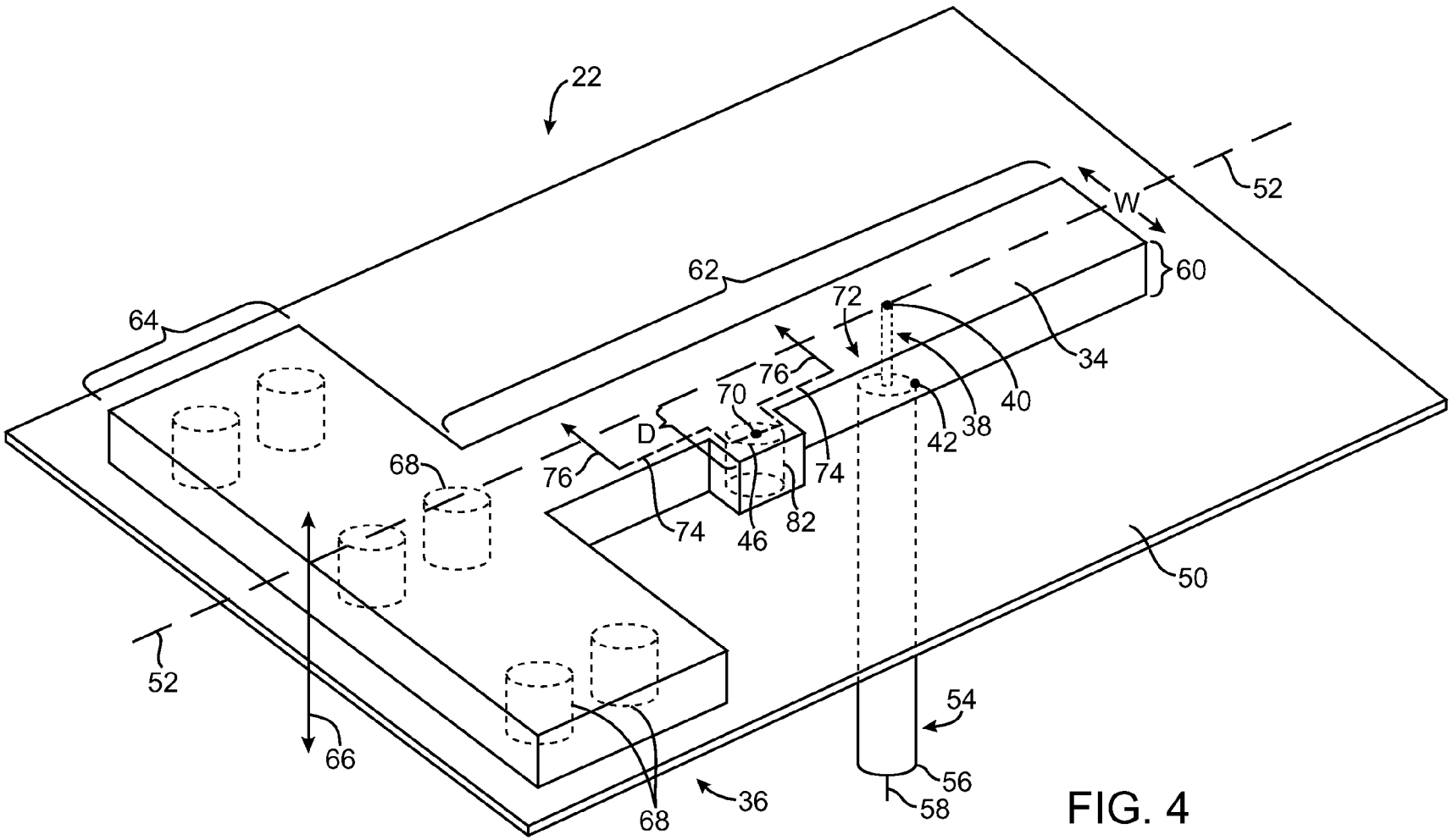
FIG. 4 is a perspective view of an illustrative inverted-F antenna having a short circuit structure of the type shown in FIG. 3 that has been implemented using a conductive via in a printed circuit board substrate in accordance with an embodiment of the present invention.

An illustrative antenna 22 that has been formed using a printed circuit board is shown in FIG. 4. As shown in FIG. 4, antenna 22 may have ground plane element 50 and resonating element 34. Ground plane element 50 may be formed from a planar conductive layer such as the underside of a two-sided printed circuit board. Resonating element 34 may be formed from a planar conductive layer such as the upper side of a two-sided printed circuit board. Dielectric layer 60 may be formed from rigid printed circuit board dielectric (e.g., fiberglass-filled epoxy) or other suitable dielectric materials. Layer 60 generally covers all of ground plane layer 50 (e.g., in the shape of a rectangle or other convenient printed circuit board shape), but only the portion of dielectric 60 that lies directly beneath conductive layer 34 in FIG. 4 is shown in FIG. 4).

As shown in FIG. 4, resonating element layer 34 may have a shape such as a T-shape with an elongated portion 62 and a base portion 64. Elongated portion 62 may be, for example, a rectangular region having a length that is substantially longer than its width. In the FIG. 4 example, the length of region 62 runs parallel to longitudinal axis 52 of element 34 and antenna 22. Portion 62 may, in general, have any suitable shape. For example, portion 62 may have one or more arms, may have one or more bent portions (e.g., to form a meandering path), may have protrusions, etc. The arrangement of FIG. 4 in which elongated portion 62 is formed from an elongated planar rectangular conductive member is merely illustrative.

In base region 64 of resonating element 34, one or more vertical conductive structures may be provided that connect resonating element 34 to ground 50. These vertical conductive structures may run parallel to vertical dimension 66 and form shorting branch 36 of antenna 22 (FIG. 3). Any suitable conductive materials may be used to form shorting branch 36. In the example of FIG. 4, shorting branch 36 has been formed by conductive vias 68. Vias 68 are short columns of metal or other conductive materials that short resonating element 34 to ground plane 50. There are six vias 68 in the example of FIG. 4. In general, any suitable number of vias 68 or other vertical shorting structures may be used to electrically connect upper planar resonating element portion 64 with lower ground plane layer 50 and thereby from shorting branch 36.

Shorting structures 46 of FIG. 3 may be formed from metal members or other conductive structures that run parallel to vertical axis 66. In the FIG. 4 example, shorting structure 46 has been formed by a via 82 having a center 70 that is laterally offset from longitudinal axis 52 by distance D. Use of smaller distances D may increase the magnitude of the impact of via 82 on antenna performance, whereas use of relatively larger distances D (e.g., large lateral offsets from the longitudinal axis of arm 34 so that via 82 is formed under a lateral protrusion from the main conductive portion of arm 32 as shown in FIG. 3) may help prevent shorting structure 46 from exhibiting too much impact on antenna performance. This is merely illustrative. Shorting structure 46 may be formed by one or more vias, by bent metal tabs, by wires, etc.

Antenna 22 may be fed by coupling a transmission line such as coaxial cable 54 to antenna 22 at an antenna feed (feed 72) formed from antenna feed terminals such as feed terminal 40 and 42. Coaxial cable 54 may have a positive conductor and a ground conductor. The ground conductor may be provided by an outer conductive layer such as layer 56. The positive conductor may be provided by a center conductor such as center conductor 58. Center conductor 58 may be coupled to positive antenna feed terminal 40 using a vertical conductor 38. Vertical conductor 38 may be formed from an extending portion of center conductor 58, a via, or other suitable conductive structure. Ground conductor 56 may be connected to ground antenna feed terminal 42 (e.g., at ground plane 50). To improve impedance matching, a matching network may be connected to the antenna feed (e.g., using shunt-connected and series-connected components such as inductors, capacitors, resistors, conductive and dielectric structures that contribute inductance, capacitance, and resistance, etc.). Although the transmission line in the FIG. 4 example is formed from a coaxial cable, this is merely illustrative. The transmission line that connects radio-frequency transceiver 18 to antenna 22 (i.e., transmission line 20 in FIG. 1) may be implemented using a microstrip transmission line, a stripline transmission line, a coaxial cable transmission line, etc.

A broadened bandwidth is obtained for antenna 22, when antenna signals can propagate past shorting structure 46 from antenna feed 72 to reach shorting structure 36. If the effect of shorting structure 46 is too prominent, signals will be prevented from reaching shorting structures 36, so antenna 22 will function as a conventional inverted-F antenna in which shorting structures 46 form shorting branch 36 and in which there are no additional shorting structure. To ensure that shorting structures 46 do not behave in this way, the size and location of shorting structures 46 may be selected to properly scale the impact of shorting structures 46 on the operation of antenna 22.

One way in which the impact of shorting structures 46 can be adjusted relates to the location of the shorting path. As shown in FIG. 4, for example, the via that makes up shorting path 46 may be offset somewhat (e.g., by lateral distance D) relative to central longitudinal axis 46.

Another way in which the impact of shorting structures 46 can be adjusted is by ensuring that the size of vias such as via 82 is not too large. If there are too many vias or the vias have lateral dimensions that are too large, shorting structures 46 may exhibit an undesirably large amount of shorting. In the FIG. 4 example, there is only one via 46 and its diameter is significantly less than the lateral dimension (width W) of elongated portion 62.

Figure 5:
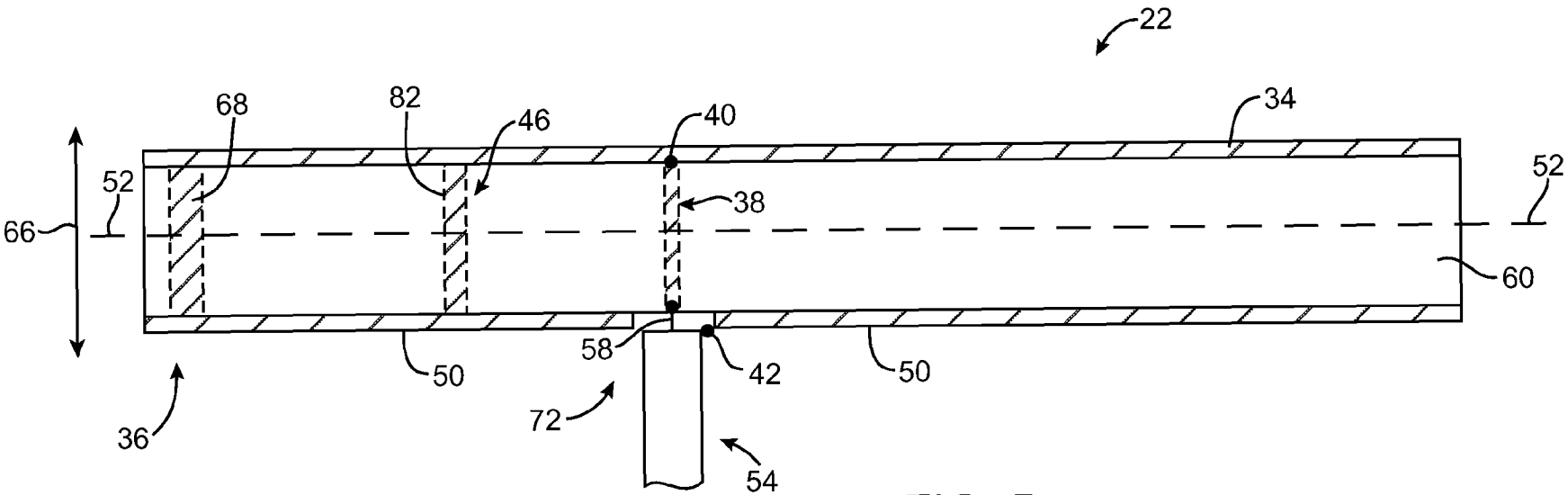
FIG. 5 is a cross-sectional view of an inverted-F antenna with a short circuit structure implemented using a conductive via in a printed circuit board substrate of the type shown in FIG. 4 in accordance with an embodiment of the present invention.

FIG. 5 shows a cross-sectional view of an illustrative printed circuit board antenna 22 of the type shown in FIG. 4 taken along line 74 in FIG. 4 and viewed in direction 76. As shown in FIG. 5, antenna resonating element structure 34 may be formed from a planar conductive layer that is separated from an associated planar ground layer 50 by a layer of dielectric 60 (e.g., a layer of rigid or flexible printed circuit board material). Conductive structures such as structures 68, 46, and 38 may be formed from one or more vias or other structures that run parallel to vertical dimension 66. Resonating element arm 34 has a longitudinal axis that runs parallel to longitudinal axis 52 of antenna 22. Coaxial cable 54 may be coupled to antenna feed 72 by connecting outer conductive layer 56 to ground plane conductive layer 50 at terminal 42 (e.g., using a solder connection, a weld, a coaxial connector, or other suitable electrical connector) and by electrically coupling center conductor 58 to vertical conductive member 38. Vertical member 38 may be formed from one or more vias, a wire, an extended portion of center conductor 58, or any other suitable vertically extending conductor. Vertical member 38 may be coupled to antenna resonating element arm 34 at point 40 (e.g., using solder, a weld, an electroplated via connection, etc.).

Figure 6:
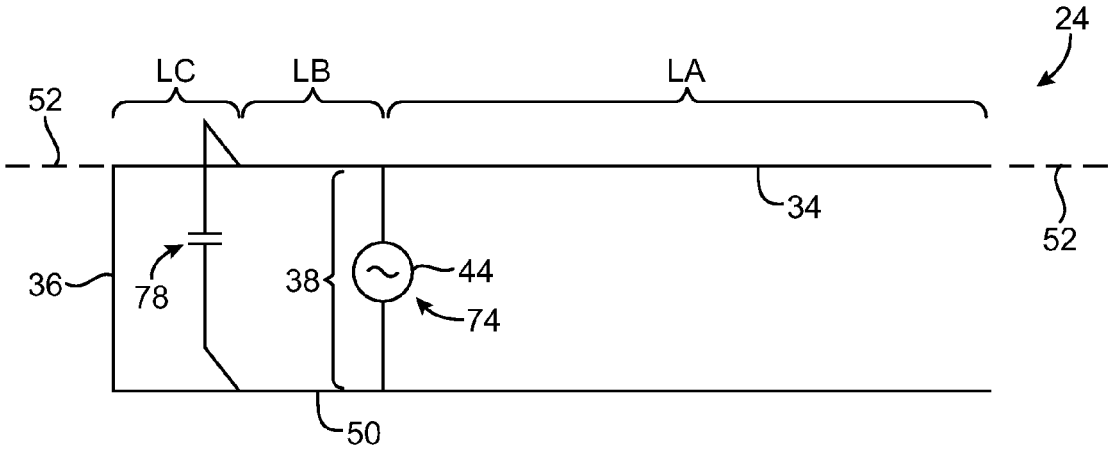
FIG. 6 is a diagram of an illustrative inverted-F antenna that has a capacitance discontinuity structure that enhances antenna bandwidth in accordance with an embodiment of the present invention.

If desired, an electrical (impedance) discontinuity along the length of the resonating element arm 34 may be generated using a capacitance discontinuity structure. The capacitance discontinuity structure may, for example, be located between feed 72 and shorting branch 36 of antenna 22, as shown schematically by capacitance discontinuity 78 of FIG. 6.

Capacitance discontinuity 78 can be implemented by structures that locally increase or decrease the capacitance of antenna resonating element 34. Capacitance discontinuity 78 may, for example, be located at a distance LB from feed 74 and a distance LC from shorting branch 36. Capacitance discontinuity 78 may be offset laterally from longitudinal axis 52 of resonating element 34 as shown schematically in FIG. 6. In arrangements such as these, the vias or other structures used to form capacitance impedance discontinuity 78 are offset sufficiently so as not to lie directly beneath the conductive portions of antenna resonating element arm 34, thereby preventing the impact of discontinuity 78 from becoming too large and overwhelming the performance characteristics of antenna 22.

As with the electrical discontinuity produced with shorting structure 46 of FIG. 3, capacitance discontinuity structure 78 may create two impedance contributions for antenna 22—a first impedance characteristic that is associated with the signal path between feed 74 and shorting structure 36 (corresponding to path length LB+LC) and a second impedance characteristic associated with the signal path between feed 74 and capacitance discontinuity 78 (of path length LB).

Capacitance discontinuity 78 may be generated using a structure that adds a local capacitance to arm 34 such as an added metal patch or locally increased dielectric constant region in dielectric 60 or may be generated using as structure that removes a local capacitance from arm 34.

Figure 7:
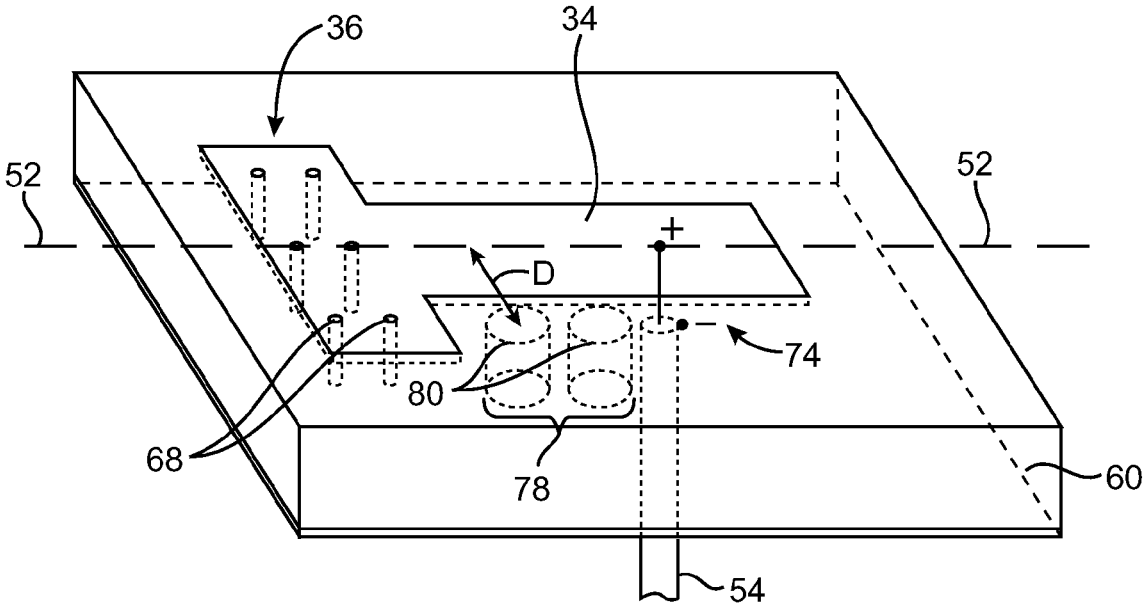
FIG. 7 is a perspective view of an illustrative inverted-F antenna having a capacitance discontinuity structure of the type shown in FIG. 6 that has been implemented using holes in a printed circuit board dielectric layer under the inverted-F antenna resonating element conductive layer in accordance with an embodiment of the present invention.

An illustrative arrangement in which capacitance discontinuity 78 is generated by hollowing out portions of dielectric 66 or otherwise locally increasing or decreasing the dielectric constant of the dielectric at a location adjacent to antenna resonating element 34 is shown in FIG. 7. As shown in the example of FIG. 7, antenna 22 may have a conductive member such as antenna resonating element arm 34 that is separated from conductive ground plane member 50 by a dielectric layer 60. Dielectric layer 60 may be formed from a dielectric such a printed circuit board dielectric (e.g., fiberglass-filled epoxy, flex circuit dielectrics such as polyimide, etc.). Capacitance discontinuity structure 78 may be formed by creating one or more altered-dielectric-constant regions 80 in dielectric layer 60. Regions 80 may be filled with dielectric that has a lower dielectric constant than dielectric 60. For example, regions 80 may be created by hollowing out portions of dielectric 60 so that they become filled with a gas such as air. Regions 80 may also be filled with a dielectric that has a greater dielectric constant than dielectric 60 (e.g., by locally treating dielectric 60 or by hollowing out regions 80 and filling the hollowed regions with a dielectric with a greater dielectric constant than dielectric 60. Combinations of these techniques may also be used. Regions 80 may be laterally offset from longitudinal axis 52 by a distance D to avoid overwhelming antenna 22 with the presence of capacitance discontinuity 78.

Any suitable dielectric materials can be used to form dielectric layer 60 and regions 80. For example, layer 60 and/or region 80 may be formed from a completely solid dielectric, a porous dielectric, a foam dielectric, a gelatinous dielectric (e.g., a coagulated or viscous liquid), a dielectric with grooves or pores, a dielectric having a honeycombed or lattice structure, a dielectric having spherical voids or other voids, a combination of such non-gaseous dielectrics, etc. Hollow features in solid dielectrics may be filled with air or other gases or lower dielectric constant materials. Examples of dielectric materials that may be used in antenna 22 and that contain voids include epoxy with gas bubbles, epoxy with hollow or low-dielectric-constant microspheres or other void-forming structures, polyimide with gas bubbles or microspheres, etc. Porous dielectric materials used in antenna 22 can be formed with a closed cell structure (e.g., with isolated voids) or with an open cell structure (e.g., a fibrous structure with interconnected voids). Foams such as foaming glues (e.g., polyurethane adhesive), pieces of expanded polystyrene foam, extruded polystyrene foam, foam rubber, or other manufactured foams can also be used in antenna 22. If desired, the dielectric antenna materials for layer 60 and/or regions 80 can include layers or mixtures of different substances such as mixtures including small bodies of lower density material.

Figure 8:
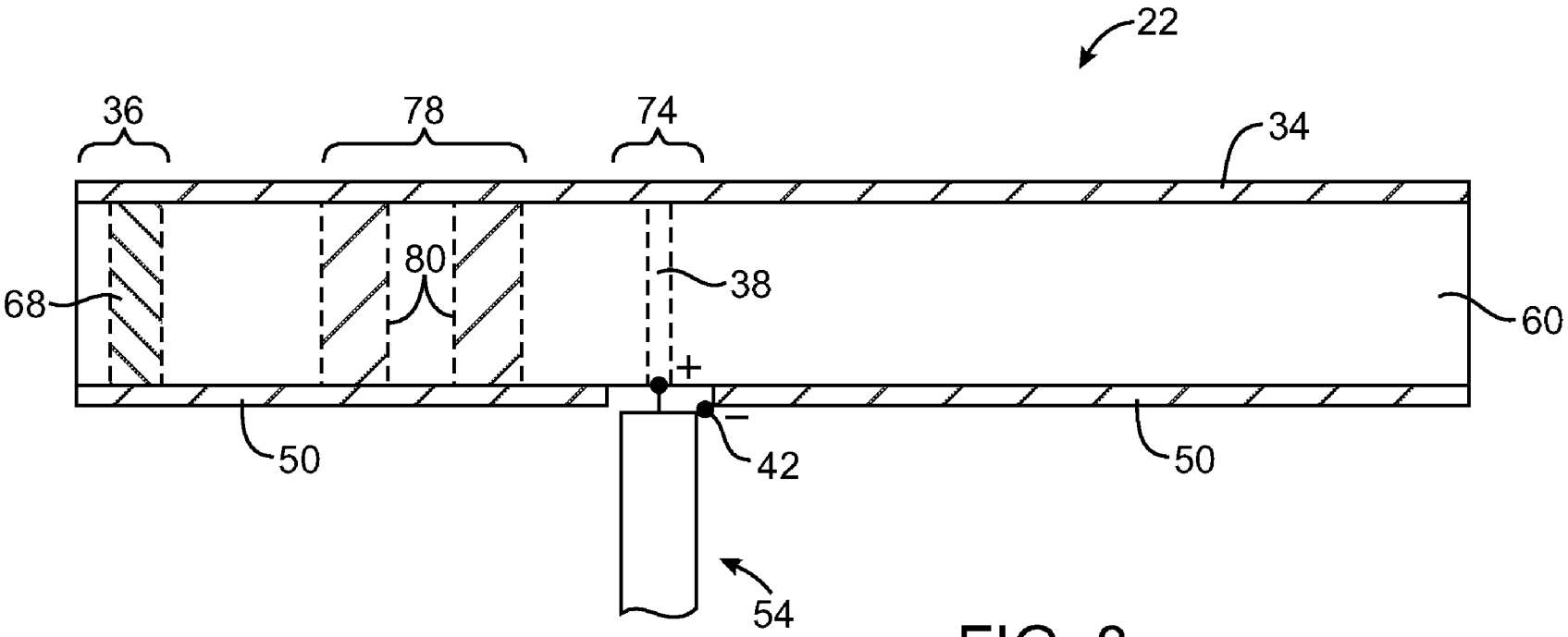
FIG. 8 is a cross-sectional view of an inverted-F antenna with capacitance discontinuity structures of the type shown in FIG. 7 in accordance with an embodiment of the present invention.

FIG. 8 is a cross-sectional side view of antenna 22 of FIG. 7. As shown in FIG. 8, antenna 22 may have an antenna resonating element arm layer 34 formed from a thin layer of metal (e.g., copper traces) on a layer of dielectric 60. Dielectric layer 60, in turn, may be formed on ground layer 50 (e.g., a planar conductive layer on the underside of a printed circuit board). Shorting branch 36 may be formed with one or more vias 68 or other vertical conducting structures. Feed 74 may be formed by coupling a transmission line such as coaxial cable 54 to antenna 22 using positive and ground antenna feed terminals. Capacitance discontinuity structure 78 may be located between feed 74 and shorting branch 36 (not shown to scale in FIG. 8). Capacitance discontinuity structure 78 may be formed from regions 80 that are hollow or are otherwise filled with a dielectric substance that has a different dielectric constant than surrounding portions of dielectric layer 60.

Figure 9:
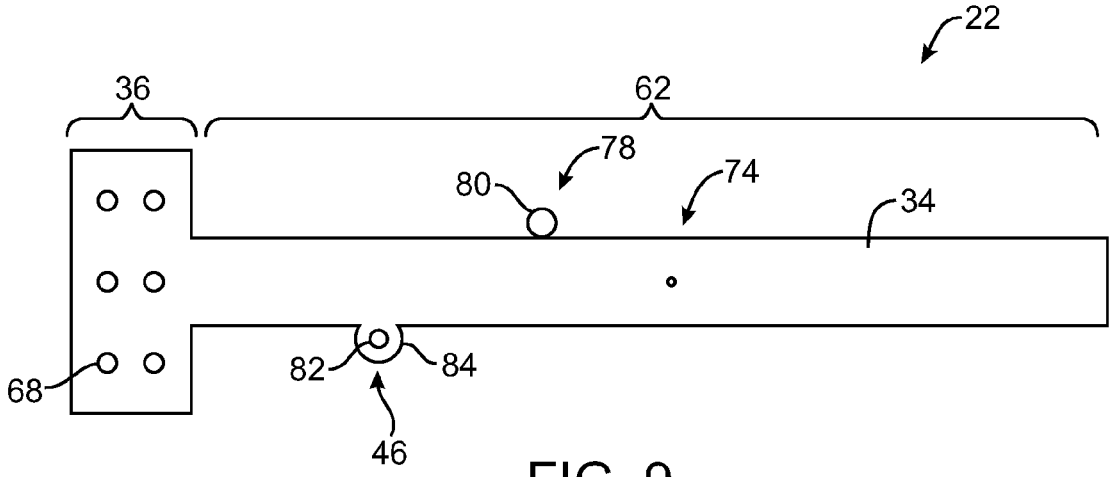
FIG. 9 is a top view of an illustrative inverted-F antenna having a short circuit structure that has been formed using a via connected to a laterally protruding portion of an antenna resonating element in accordance with an embodiment of the present invention.

FIG. 9 is a top view of an illustrative antenna 22 showing how a given antenna may contain both an impedance discontinuity structure such as capacitance discontinuity structure 78 and an impedance discontinuity structure such as shorting structure 46 that are located along the length of elongated portion 62 of antenna resonating element arm 34 between feed 74 and shorting branch 36. As shown in FIG. 9, shorting structure 46 may be formed from via 82, which is electrically connected to protrusion 84 in the conductive trace that makes up resonating element arm 34. Forming shorting structure 46 at least partly using a protrusion that extends laterally from the side arm 34 helps ensure that shorting structure 46 is not too powerful and does not create a short that completely blocks signals from feed 74 before they reach shorting branch 36. Hole 80 for capacitance discontinuity structure 78 may also be laterally offset from the longitudinal axis of resonating element arm 34.

Figure 10:
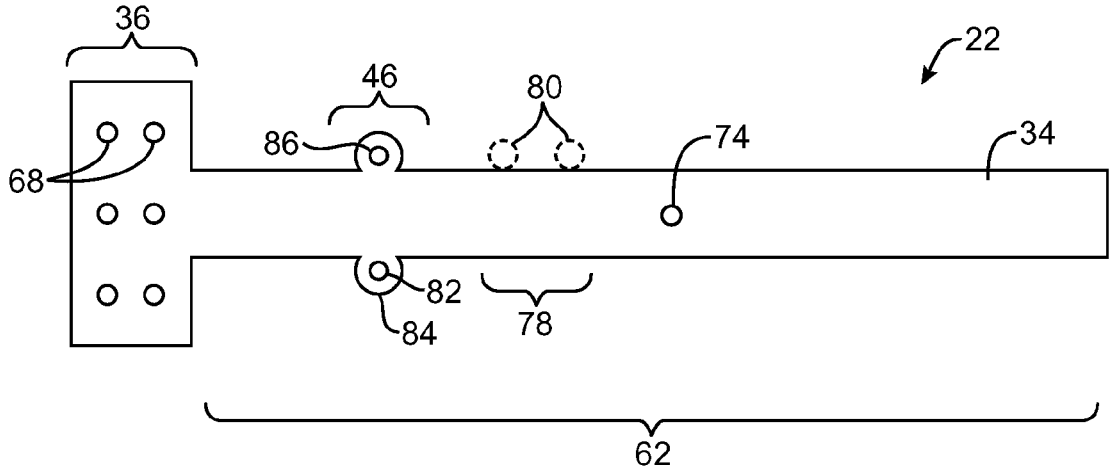
FIG. 10 is a top view of an illustrative inverted-F antenna having a first short circuit structure that has been formed using a via connected to a protruding portion of an antenna resonating element, having a second short circuit structure that has been formed using a via at a laterally offset location along the main branch of the antenna resonating element, and having capacitance discontinuity structures in accordance with an embodiment of the present invention.

As shown in FIG. 10, protrusions such a protrusion 84 may be used in forming shorting structures 46 in antenna configurations having other shorting structures. In the FIG. 10 example, protrusion 84 and associated via 82 form a first shorting structure and via 86 forms a second shorting structure. FIG. 10 shows how a shorting structure 46 with multiple vias such as vias 86 and 82 may be formed on the same elongated resonating element arm portion 62 as a capacitance discontinuity structure that contains multiple regions 80. Different longitudinal and/or lateral locations may be used for shorting vias in structure 46 if desired to tune antenna performance (e.g., to adjust bandwidth and/or to reduce or increase the magnitude of the impact of shorting structure 46 on antenna performance).

Figure 11:
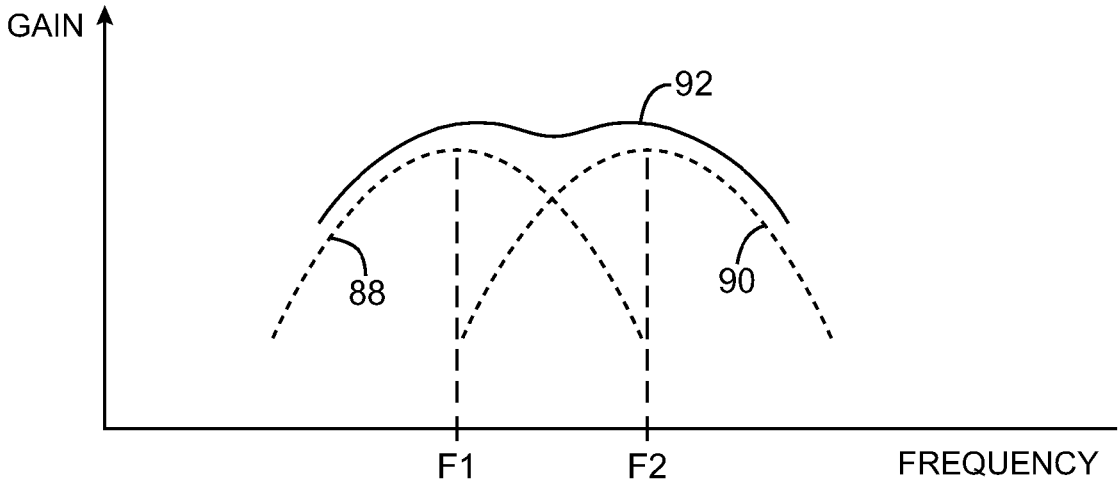
FIG. 11 is a graph showing how the bandwidth of an inverted-F antenna may be enhanced by incorporating shorting structures and capacitance discontinuity structures in accordance with an embodiment of the present invention.

The type of gain broadening effect that may be exhibited by antennas 22 with shorting structures 46 and/or capacitance discontinuity structures is shown in FIG. 11. In the graph of FIG. 11, antenna gain for antenna 22 is plotted as a function of operating frequency. In the absence of impedance discontinuity structures such as shorting structures 46 and capacitance discontinuity structures 78, an antenna with a given resonating element arm 34, dielectric layer 60, and ground 50 may exhibit a first (unperturbed) gain curve such as curve 88 centered at frequency F1. The presence of a shorting structure such as shorting structure 46 and/or the presence of a capacitance discontinuity structure such as capacitance discontinuity structure 78 perturbs the impedance of antenna 22 and thereby contributes to the generation of a shifted gain curve such as gain curve 90 centered at frequency F2. In operation, when transmitting and receiving radio-frequency signals (e.g., using radio-frequency transceiver circuitry 18 of FIG. 1), antenna 22 may exhibit an overall gain curve such as gain curve 92 that has a relatively broad bandwidth (e.g., covering subbands at both frequency F1 and frequency F2).

The foregoing is merely illustrative of the principles of this invention and various modifications can be made by those skilled in the art without departing from the scope and spirit of the invention.

What is claimed is:

1. An inverted-F antenna comprising:

an antenna ground element;

a resonating element arm that is shorted to the antenna ground element at a shorting branch of the resonating element arm;

an antenna feed coupled to the resonating element arm and the antenna ground element;

a shorting structure that shorts the resonating element arm to the antenna ground element at a location between the shorting branch and the antenna feed;

a dielectric layer between the resonating element arm and the antenna ground element; and a capacitance discontinuity structure in the dielectric layer.

2. The inverted-F antenna defined in claim 1 wherein the resonating element arm comprises a planar resonating element arm conductor and wherein the antenna ground element comprises a planar antenna ground element.

3. The inverted-F antenna defined in claim 2 wherein the dielectric layer comprises printed circuit board dielectric and wherein the resonating element arm conductor comprises a T-shaped trace on the dielectric.

4. The inverted-F antenna defined in claim 1 wherein the resonating element arm comprises a planar resonating element arm conductor, wherein the antenna ground element comprises a planar antenna ground element, wherein the dielectric layer comprises a planar dielectric layer between the planar resonating element arm conductor and the planar antenna ground element, and wherein the capacitance discontinuity structure is in the planar dielectric layer adjacent to the resonating element arm conductor.

5. The inverted-F antenna defined in claim 4 wherein the capacitance discontinuity structure comprises a hollow region adjacent to the planar resonating element arm conductor.

6. The inverted-F antenna defined in claim 4 wherein the planar dielectric layer has a first dielectric constant and wherein a portion of the planar dielectric layer serves as the capacitance discontinuity structure and has a second dielectric constant that is different than the first dielectric constant.

7. The inverted-F antenna defined in claim 4 wherein the planar dielectric layer has a first dielectric constant and wherein a portion of the planar dielectric layer serves as the capacitance discontinuity structure and has a second dielectric constant that is less than the first dielectric constant.

8. An inverted-F antenna comprising:

an antenna ground element;

a resonating element arm that is shorted to the antenna ground element at a shorting branch of the resonating element arm;

an antenna feed coupled to the resonating element arm and the antenna ground element;

a capacitance discontinuity structure that introduces an altered capacitance to the resonating element arm at a location along the resonating element arm that is between the shorting branch and the antenna feed; and a dielectric layer between the resonating element arm and the antenna ground element, wherein the dielectric layer comprises at least one portion that serves as the capacitance discontinuity structure.

9. The inverted-F antenna defined in claim 8 wherein the resonating element arm comprises a planar resonating element arm conductor, wherein the antenna ground element comprises a planar antenna ground element, and wherein the dielectric layer comprises a planar epoxy dielectric layer between the planar resonating element arm conductor and the planar antenna ground element.

10. The inverted-F antenna defined in claim 8 wherein the resonating element arm comprises a planar resonating element arm conductor, wherein the antenna ground element comprises a planar antenna ground element, and wherein the a dielectric layer is between the planar resonating element arm conductor and the planar antenna ground element.

11. The inverted-F antenna defined in claim 10 wherein the at least one portion of the dielectric layer that serves as the capacitance discontinuity structure comprises portions that define at least one gas-filled hollow region adjacent to the planar resonating element arm conductor that serves as the capacitance discontinuity structure.

12. The inverted-F antenna defined in claim 10 wherein the at least one portion of the dielectric layer that serves as the capacitance discontinuity structure is adjacent to the planar resonating element arm conductor.

13. The inverted-F antenna defined in claim 12 wherein the dielectric layer has a first dielectric constant and wherein the portion of the dielectric layer that serves as the capacitance discontinuity structure has a second dielectric constant that is different than the first dielectric constant.

14. The inverted-F antenna defined in claim 13 further comprising:

a shorting structure that shorts the resonating element arm to the antenna ground element at a location along the resonating element arm that is between the shorting branch and the antenna feed.

15. The inverted-F antenna defined in claim 14 wherein the shorting structure comprises at least one via that passes through the dielectric layer and electrically connects the resonating element arm to the antenna ground element.

16. The inverted-F antenna defined in claim 15 wherein the resonating element arm comprises an elongated conductive member having a central longitudinal axis and wherein the via of the shorting structure is connected to the elongated conductive member at a location that is laterally offset from the central longitudinal axis in a lateral direction perpendicular to the central longitudinal axis.

17. The inverted-F antenna defined in claim 16 wherein the elongated conductive member comprises a lateral protrusion and wherein the via of the shorting structure is connected to the elongated conductive member at the protrusion.

18. The inverted-F antenna defined in claim 8 further comprising:

a shorting structure that shorts the resonating element arm to the antenna ground element at a location along the resonating element arm that is between the shorting branch and the antenna feed.

19. An electronic device, comprising:

a radio-frequency transceiver;

a transmission line coupled to the radio-frequency transceiver to receive and transmit radio-frequency signals; and an antenna having:

a dielectric layer;

an antenna ground element;

a resonating element arm that is separated from the antenna ground element by the dielectric layer and that is shorted to the antenna ground element by a shorting branch of the resonating element arm at an end of the resonating element arm;

an antenna feed that is coupled to the resonating element arm and the antenna ground element and that receives the transmission line; and at least one via that passes from the resonating element arm to the antenna ground element through the dielectric layer and shorts the resonating element arm to the antenna ground element at a location along the resonating element arm that is located between the shorting branch and the antenna feed, wherein there is no flat plane that passes through substantially all of the shorting branch, the antenna feed, and the via.

20. The electronic device defined in claim 19 wherein the dielectric layer comprises a portion of a printed circuit board and wherein the shorting branch comprises at least one shorting branch via through the dielectric layer.

21. The electronic device defined in claim 19 wherein the at least one via comprises at least four vias.

22. The electronic device defined in claim 19 wherein there is no straight line that passes through the shorting branch, the antenna feed, and the via.

* * * * *